US007659008B2

(12) United States Patent
Martin et al.

(10) Patent No.: US 7,659,008 B2
(45) Date of Patent: Feb. 9, 2010

(54) COMPOSITE MATERIAL COMPOSED OF A METAL MATRIX AND OF TALC

(75) Inventors: François Martin, Sainte Foy d'Aigrefeuille (FR); Jean-Pierre Bonino, Pechabou (FR); Patrice Bacchin, Gargas (FR); Stéphane Vaillant, Albi (FR); Eric Ferrage, Toulouse (FR); William Vautrin, Saint André le Coq (FR); Philippe Barthes, Cahors (FR)

(73) Assignee: Centre National de la Recherche Scientifique, Paris (FR)

( * ) Notice: Subject to any disclaimer, the term of this patent is extended or adjusted under 35 U.S.C. 154(b) by 753 days.

(21) Appl. No.: 10/537,827

(22) PCT Filed: Dec. 8, 2003

(86) PCT No.: PCT/FR03/03625

§ 371 (c)(1), (2), (4) Date: Jan. 6, 2006

(87) PCT Pub. No.: WO2004/063428

PCT Pub. Date: Jul. 29, 2004

(65) Prior Publication Data

US 2006/0162655 A1 Jul. 27, 2006

(30) Foreign Application Priority Data

Dec. 9, 2002 (FR) ..... 02 15507

(51) Int. Cl.

| | |
|---|---|
| ***B32B 5/16*** | (2006.01) |
| ***B32B 15/00*** | (2006.01) |
| ***B32B 15/16*** | (2006.01) |
| ***C25D 15/00*** | (2006.01) |

(52) U.S. Cl. ..... 428/614; 428/615; 428/680; 428/452; 428/464; 205/109; 205/238; 205/255; 205/261; 205/271; 205/557; 205/615

(58) Field of Classification Search ..... None
See application file for complete search history.

(56) References Cited

U.S. PATENT DOCUMENTS

| | | | | |
|---|---|---|---|---|
| 3,152,972 | A | 10/1964 | Brown et al. | |
| 3,591,350 | A | 7/1971 | Stareck et al. | |
| 5,229,094 | A * | 7/1993 | Clauss et al. | 423/331 |
| 5,401,482 | A * | 3/1995 | Clauss et al. | 423/331 |
| 2003/0205344 | A1 * | 11/2003 | Lasmarias et al. | 162/158 |

OTHER PUBLICATIONS

R. Ramaswamy et al., "Occlusion Plating of Nickel-Talc Composites", Metal Finishing, Sep. 1992, pp. 23-26, vol. 90, No. 9, XP-000329877, Elsevier Science Publishing, New York, NY, US (cited in the International Search Report).

* cited by examiner

*Primary Examiner*—Jennifer McNeil
*Assistant Examiner*—Jason L Savage
(74) *Attorney, Agent, or Firm*—Crowell & Moring

(57) ABSTRACT

The invention relates to a lubricating metal coating and to a process for its preparation. The material constituting the coating in a composite material comprising a metal matrix within which talc particles are distributed as lamellae, the metal matrix being composed of a metal chosen from Fe, Co, Ni, Mn, Cr, Cu, W, Mo, Zn, Au, Ag, Pb or Sn or of an alloy of these metals or of a metal/semimetal alloy. The coating is obtained by a process consisting in carrying out an electrolytic deposition using a solution of precursors of the metal matrix of the coating which additionally comprises talc particles in suspension, which particles are modified at the surface by irreversible adsorption of a cellulose-derived compound by replacement of all or part of the hydroxyl groups.

14 Claims, No Drawings

COMPOSITE MATERIAL COMPOSED OF A METAL MATRIX AND OF TALC

CROSS-REFERENCE TO RELATED APPLICATIONS

This application is a §371 application of International Patent Application No. PCT/FR2003/003625, filed Dec. 8, 2003, and published in French on Jul. 29, 2004, as International Publication No. WO 2004/063428 A2, which claims priority to French Patent Application No. 02/15507, filed Dec. 9, 2002. The disclosures of these applications are incorporated herein in their entirety.

BACKGROUND OF THE INVENTION

1. Field of the Invention

The invention relates to a composite material, to its use as lubricating metal coating and to a process for its preparation.

2. Description of the Related Art

Use is made, in numerous industrial fields, such as, for example, transportation, the connector industry or the armaments industry, of mechanical assemblies in which components in contact are in movement with respect to one another. In numerous cases, it is desirable to treat the surfaces of the components in contact in order to confer thereon, in addition to their fundamental properties, lubricating properties which are stable toward high temperatures, in order to increase the lifetime and the reliability of the mechanical assemblies in which the surfaces are in contact.

It is known to deposit lubricating composite coatings by electrolytic processes, either by the chemical route (electroless process) or by the electrochemical route. An "electroless" process for codeposition on a substrate is a process consisting in incorporating particles during the process of growth of a metal or of an alloy by catalyzed oxidation/reduction. A process for codeposition by the electrochemical route consists in incorporating particles during the process of growth of a metal or of an alloy on a substrate to be coated, starting from an electrolyte in an electrolysis cell.

For example, the deposition of a lubricating coating of PTFE in a nickel-based metal matrix by an "electroless" process starting from a suspension of a PTFE in a solution of nickel precursor is known from X. Hu et al. (Plating and Surface Finishing, March 1997). However, the coatings of this nature are unstable, the PTFE being destroyed at temperatures of greater than 300° C.

The preparation of NiP antifriction deposited layers incorporating inorganic fullerene-$WS_2$ nanoparticles by an "electroless" process is described in particular by W. X. Chen et al. [Advanced Engineering Materials, vol. 4, No. 9, September 2002]. It is also possible to deposit NiP—$B_4C$ lubricating coatings by the "electroless" technique [cf. J. P. Ge et al., Plating and Surface Finishing, October 1998].

In addition, Ni—$BN_h$ coatings are described by M. Pushpavanam et al. [Metal Finishing, June 1995] and composite coatings formed of nickel charged with $MoS_2$ are described by Yu-Chi Chang et al. [Electrochimica Acta, vol. 43, Issues 3-4, 1998, pp. 315-324]. In both cases, the coatings can be obtained by the electro-chemical route. However, boron nitrides have very low chemical resistances in acidic and basic media.

SUMMARY OF THE INVENTION

The aim of the present invention is to provide a material which exhibits the properties of hardness and of resistance to wear conventionally required for mechanical components in contact and in movement with respect to one another in a mechanical assembly and lubricating properties which are stable at high temperatures, for example of the order of 800° C. For this reason, a subject matter of the present invention is a composite material, its use as self-lubricating coating for a substrate, and a process for its preparation.

The composite material according to the invention is composed of a metal matrix within which lamellar talc particles are distributed. It is characterized in that the talc particles carry, at their surface, a cellulose-derived compound attached by replacement of all or part of the hydroxyl groups.

DETAILED DESCRIPTION OF THE PREFERRED EMBODIMENTS

The metal matrix can be composed of a metal chosen from Fe, Co, Ni, Mn, Cr, Cu, W, Mo, Zn, Au, Ag, Pb or Sn, of an intermetallic compound or an alloy of several metals chosen from the abovementioned metals, or of an alloy of one or more of said metals with a semimetal. The composite materials where the matrix is nickel, a metal alloy of nickel with other metals or an alloy of nickel with a semimetal (for example NiP) are particularly advantageous.

The unmodified talc is a magnesium silicate corresponding to the formula $Mg_3Si_4O_{10}(OH)_2$ which forms part of the family of the phyllosilicates and which exists in the form of a stack of lamellae. The individual lamella has a thickness of 0.9 nm. It loses its water of constitution at approximately 800° C. and decomposes at approximately 950° C. The properties which it confers on a composite material are consequently stable up to 950° C.

The presence of modified particles of talc in the composite material according to the invention can be determined using various analytical techniques. The Scanning Electron Microscopy (SEM) images show that the treated talc has, at the surface, groups derived from cellulose with a size of the order of a micrometer. Scanning electron microscopy/energy dispersive X-ray (SEM-EDX) analysis after metallization with Au, low voltage SEM analysis or Electron Spectroscopy for Chemical Analysis (ESCA) give amounts of C, which show the presence of an organic compound at the surface. X-ray diffraction, by virtue of the use of multielement detectors and of the reduction in the size of the analysis spot (10 to 100 $\mu m_2$), makes it possible to confirm the existence of cellulose derivatives at the surface of the talc particles, the size of the spot and the size of the groups of cellulose derivatives on the talc being substantially identical. Diffuse reflectance Fourier Transform Infrared Spectrometry shows the presence of vibrational bands specific to the talc and of vibrational bands specific to the groups bonded to the carbons of the cellulose derivative, the positions of the respective vibrational bands being different.

The same studies can be carried out by Raman spectroscopy (point laser). The coating of the talc particles with a cellulose derivative in the composite material of the invention can also be demonstrated by the micro-PIXE (particle-induced X-ray emission) technique, which makes possible a chemical analysis of the order of a micrometer, and by the EXAFS (extended X-ray absorption fine structure) technique, which makes possible the determination of the ligands of the atom probed and of the interatomic distances around the ligand down to 6 nm.

It appears that the introduction of talc, which is a relatively soft material, into the metal matrix does not modify the properties of hardness and of resistance to abrasion inherent in the material constituting said matrix.

The composite material according to the invention can advantageously be used as coating on a substrate.

A coating composed of a composite material according to the invention can be deposited by the electrolytic route on the substrate to be treated.

The process for the deposition on a substrate of a coating composed of the composite material according to the invention consists in carrying out an electrolytic deposition using a solution of precursors of the metal matrix of the coating. It is characterized in that the solution of precursors additionally comprises talc particles in suspension, said talc particles having been modified beforehand at the surface by irreversible adsorption of a cellulose-derived compound by replacement of all or part of the hydroxyl groups.

In one embodiment, the deposition process is carried out by the chemical route by bringing the surface of the substrate to be coated into contact with the solution comprising the precursors of the metal matrix, the modified particles of talc and a compound which acts as catalyst for the oxidation/reduction of the precursors of the metal matrix of the coating.

In another embodiment, the deposition process is carried out by the electrochemical route in an electro-chemical cell in which said substrate to be coated constitutes the cathode and the electrolyte is a solution of precursors of the metal matrix of the coating additionally comprising the modified particles of talc.

Mention may be made, as examples of cellulose-derived compound (subsequently denoted by CDC), of carboxy-methylcellulose (CMC) and guar.

CMC is a cellulose ether resulting from the reaction of alkali metal cellulose and of sodium monoacetate.

A portion of the hydroxyl groups of the cellulose is replaced with sodium carboxymethyl groups (—$CH_2COONa$). The respective formulae of the repeat unit of cellulose and of the repeat unit of CMC are represented below.

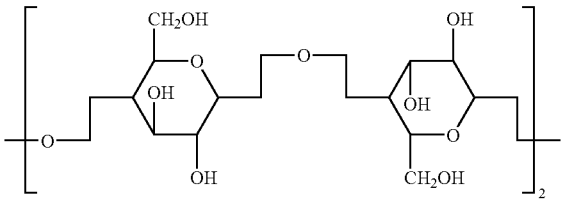

Structure of cellulose

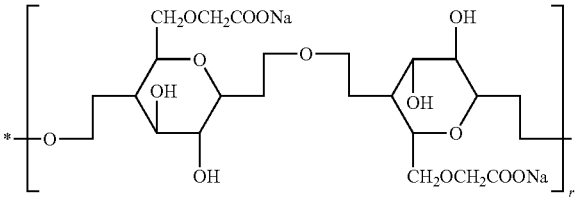

Ideal structure of sodium carboxymethylcellulose (degree of substitution DS = 1.0)

CMC can exhibit various degrees of substitution. The degree of substitution DS is equal to 3 in theory. In practice, the DS is markedly less than 3. Commercial CMCs exhibit DS values ranging from 0.6 to 0.95. The dissolution of CMC in water brings about ionization of the carboxymethylcellulose groups, which gives a negative charge to the CMC macromolecule. When an aqueous solution comprises a weakly substituted, more hydrophobic, CMC, it exhibits a thixotropic nature. When an aqueous solution comprises a highly substituted CMC, it exhibits a pseudoplastic nature.

The viscosity of the aqueous medium in which the CMC is dissolved depends on the length of the CMC macromolecule, that is to say on the number of anhydroglucose units, and on the critical micelle concentration. Commercial CMCs make it possible to cover a fairly broad viscosity range (10 to 9000 mPa·s) as a function of the length of the chain and of the concentration.

A guar is a cellulose compound in which certain hydroxyl (—OH) groups of a cellulose ring are substituted by hydroxyglucose groups. In this case, the possibility of substitution over a given chain length is much lower than in the case of CMC. The degrees of substitution of guar are in the vicinity of 0.1. The formula of the repeat unit of guar is represented below.

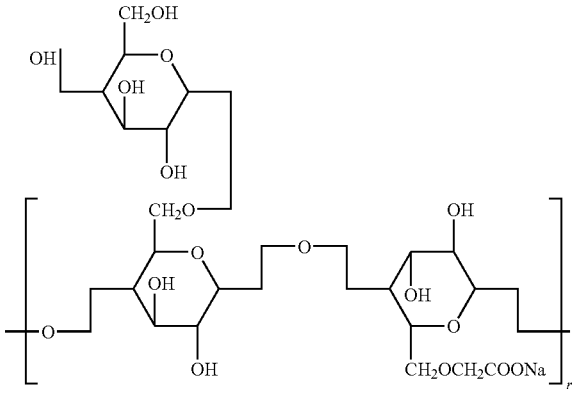

Ideal structure of guar

The process for the treatment of the talc particles with the cellulose-derived compound (CDC) comprises the following stages:

1. preparation of a CDC aqueous mother solution (20 to 80 $g.l^{-1}$);
2. preparation of a paste from demineralized water (100 ml), talc (50-150 g) and CDC (2-10 g) introduced from the CDC mother solution, homogenization being carried out with mechanical stirring (10-20 min);
3. complete evaporation of the aqueous phase of the paste in an oven (50-90° C.) until a dehydrated solid is obtained;
4. deagglomeration of the dehydrated solid in order to obtain particles of treated talc having a particle size identical to that of the initial talc powder;
5. first cycle: washing with demineralized water, centrifuging to separate the talc particles, evaporating the water in an oven and deagglomerating;
6. second washing/centrifuging/evaporating/deagglomerating cycle under the same conditions;
7. sieving.

The addition to the electrolyte of untreated particles of talc has been envisaged. However, it turned out that, due to the strongly hydrophobic nature of the talc, suspending without precautions in the aqueous medium which the electrolyte constitutes brings about the formation of agglomerates and of foam. The effective concentration of talc in the suspension is then very low and the amount of talc in the coating obtained is insufficient to confer true lubricating properties. The addition of known wetting agents was tested and it restricts the formation of foam and the agglomeration of talc particles in the absence of stirring. These suspensions cannot be used under standard deposition conditions since they cannot be stirred due to the risk of trapping air and thus of locking up a portion of the talc in the foam formed. The addition of a conventional wetting agent exhibits in addition the disadvantage of modifying the characteristics of the matrix of the coating if the wetting agent is in excess with respect to the amount of particles in suspension.

The inventors have finally found that the preliminary modification of the talc particles using a cellulose compound in which at least a portion of the OH groups are substituted makes it possible to solve these problems.

The talc particles preferably have a mean size of less than 15 μm.

The precursors of the metal matrix are chosen from complexed or noncomplexed ionic compounds which can be reduced in solution by the chemical route or by supplying electrons. Mention may be made, as examples, of salts, such as chlorides, sulfates or sulfamates, and complexes, such as citrates and acetates.

The solution of precursors additionally comprises one or more compounds which make it possible to adjust the pH to the desired value, along with the particles of modified talc.

When a coating comprising a nickel matrix is deposited by the electrochemical route, the electrolyte is a solution comprising at least one nickel salt chosen from nickel sulfate and nickel chloride, a pH-regulating agent and a support electrolyte. Boric acid is a particularly preferred pH regulator; at pH 4.5, it forms a complex with the nickel with the release of an $H^+$ and it thus balances the reduction of $H^+$ ions at the cathode. Mention may be made, as examples of support electrolyte, for example, of sodium sulfate, magnesium sulfate and sodium bromide.

When a coating comprising a nickel/phosphorus matrix is deposited by the electrochemical route, it is possible to use an electrolyte comprising at least one nickel salt chosen from nickel sulfate and nickel chloride, a pH-regulating agent, a phosphorus precursor and a support electrolyte. $H_3PO_3$ is advantageously chosen as phosphorus precursor. The pH regulator can be chosen from $H_3PO_4$ and $H_3BO_3$, $H_3PO_4$ being particularly preferred. Mention may be made, as examples of support electrolyte, for example, of sodium sulfate, magnesium sulfate and sodium bromide.

When a coating comprising a zinc/nickel matrix is deposited by the electrochemical route, it is possible to use basic or acidic electrolytes comprising at least one nickel salt chosen from nickel sulfate and nickel chloride, at least one zinc oxide or one zinc salt, such as zinc chloride, a complexing agent of the amine type and a support electrolyte, such as, for example, KCl.

The process is carried out under the standard conditions for electrochemical depositions. The duration of the electrolysis depends in particular on the thickness desired for the coating. The temperature in the electrochemical cell is advantageously between 0° C. and 90° C. and the current density applied to the cell is between 0.1 and 10 $A.dm^{-2}$. Use is preferably made of an electrochemical cell in which the anode is of the soluble anode type composed of the metal to be deposited.

The substrate can be composed of an intrinsically conducting material (for example a metal or an alloy) used in the massive state or in the form of a coating on any support. The substrate can in addition be composed of an insulating or semiconducting material (for example a polymer or a ceramic), of which the surface to be treated has been rendered conducting by a preliminary stage of metallization.

The mechanical properties of the composite coatings were tested with a tribometer of the pin-on-disk type in which the pin (which constitutes the antagonist body) is a ball of 100C6 steel which has a hardness of 1000 Hv. When a disk composed solely of nickel is used, the adhesion of the nickel to the steel is displayed by a high coefficient of friction and a significant degree of wear of the steel ball. When the disk used is composed of a nickel/talc composite material according to the invention, the coefficient of friction and the degree of wear are greatly reduced.

The present invention is described in more detail by the following examples, to which it is not, however, limited.

EXAMPLE 1

Preparation of Modified Particles of Talc

Modified particles of talc were prepared using 3 samples of carboxymethylcellulose (CMC), the characteristics of which (degree of substitution, which causes the charge, and viscosity, which depends on the chain length) are given in the table below.

| Reference | Degree of substitution | Viscosity |
|---|---|---|
| 21901 | 0.78 | 15-50 mPa · s (4% by weight sol.) |
| 21900 | 0.79 | 500-2500 mPa · s (4% by weight sol.) |
| 21903 | 0.92 | 700-1500 mPa · s (1% by weight sol.) |

The treatment was carried out under the following conditions:

- preparation of a 50 g/l CMC aqueous mother solution,
- preparation of a paste by dispersing 100 g of talc in 100 ml of a solution obtained by addition of 5 g of CMC to demineralized water and by homogenizing using mechanical stirring for 15 min,
- complete evaporation of the aqueous phase of the paste in an oven at 80° C. until a dehydrated solid is obtained,
- deagglomeration of the dehydrated solid in order to obtain particles of treated talc with a particle size identical to that of the initial powder,
- first cycle, comprising washing with demineralized water, centrifuging in order to separate the talc particles, evaporating the water in an oven at 80° C. and deagglomerating,
- second washing/centrifuging/evaporating/deagglomerating cycle under the same conditions,
- sieving.

EXAMPLE 2

Nickel/Talc Composite Coating

The coating was prepared in an electrochemical cell composed of a nickel anode with an area of 4 $cm^2$ and a copper cathode with an area of 1.762 $cm^2$ on which the deposition is carried out.

The electrochemical cell comprises an electrolyte having a pH of 4.5 and the following composition:

| | |
|---|---|
| $NiSO_4 \cdot 6H_2O$ | 280 $g \cdot l^{-1}$ |
| $NiCl_2 \cdot 6H_2O$ | 30 $g \cdot l^{-1}$ |
| $H_3BO_3$ | 45 $g \cdot l^{-1}$ |
| $Na_2SO_4$ | 50 $g \cdot l^{-1}$ |
| Talc (ref. 21901 of example 1) | 100 $g \cdot l^{-1}$ |

Deposition is carried out while maintaining the electrolyte at a temperature of 55° C. under a current density of 2.5 $A.dm^{-2}$ for a time of 1 h 30.

Analysis by scanning electron microscopy (SEM) of the coating obtained shows that the talc lamellae incorporated in the metal matrix are perpendicular to the surface of the substrate. Qualitative chemical analysis by EDX of the surface of the composite coating reveals the peaks characteristic of the carbon present on the particles. Analysis by diffuse reflectance infrared spectrometry demonstrates the vibrational bands of the cellulose groups of the CMC and bands specific to the talc.

EXAMPLE 3

NiP/Talc Composite Coating

An electrolyte having a pH of 2 and the following composition was introduced into an electrochemical cell analogous to that used in example 2:

| | |
|---|---|
| $NiSO_4 \cdot 6H_2O$ | 210 $g \cdot l^{-1}$ |
| $NiCl_2 \cdot 6H_2O$ | 60 $g \cdot l^{-1}$ |
| $H_3PO_4$ | 45 $g \cdot l^{-1}$ |
| $H_3PO_3$ | 0-15 $g \cdot l^{-1}$ |
| $Na_2SO_4$ | 50 $g \cdot l^{-1}$ |
| Talc (ref. 21900 of example 1) | 100 $g \cdot l^{-1}$ |

Deposition is carried out while maintaining the electrolyte at a temperature of 80° C. for a time of 45 min.

Several samples were thus prepared while varying the current density. The deposition rate found (related directly to the thickness of the deposited layer obtained) as a function of the current density applied is shown in the table below.

| I ($A \cdot dm^{-2}$) | Deposition rate ($\mu m \cdot h^{-1}$) |
|---|---|
| 10 | 77.3 |
| 5 | 40 |
| 3 | 23 |
| 2 | 15 |
| 1 | 8 |
| 0.5 | 4 |

As for the coating with a pure nickel matrix of example 2, the analysis by SEM of the coating obtained shows the presence of talc lamellae incorporated in the metal matrix and qualitative chemical analysis by EDX of the surface of the composite coating reveals the peaks characteristic of the carbon present on the particles. The presence of carbon in the form of cellulose groups characteristic of CMC is confirmed by analysis by diffuse reflectance infrared spectrometry.

EXAMPLE 4

Zn—Ni/Talc Composite Coating

An electrolyte having a pH of 2 and the following composition was introduced into an electrochemical cell analogous to that used in example 2:

| | |
|---|---|
| $ZnCl_2$ | 93.7 $g \cdot l^{-1}$ |
| $NiCl_2 \cdot 6H_2O$ | 9.3 $g \cdot l^{-1}$ |
| KCl | 200 $g \cdot l^{-1}$ |
| Talc (ref. 21903 of example 1) | 100 $g \cdot l^{-1}$ |

Deposition is carried out while maintaining the electrolyte at a temperature of 55° C. under a current density of 5 $A.dm^{-2}$ for a time of 12 minutes.

Analyses analogous to those carried out for example 3 gave analogous results, showing the presence of cellulose groups in the material of the coating.

What is claimed is:

1. A composite material comprising a metal matrix within which lamellar talc particles are distributed, wherein the talc particles carry, at their surface, a cellulose-derived compound attached by replacement of all or part of the hydroxyl groups.

2. The composite material as claimed in claim 1, wherein the metal matrix is composed of a metal chosen from Fe, Go, Ni, Mn, Cr, Cu, W, Mo, Zn, Au, Ag, Pb or Sn, of an intermetallic compound or an alloy of several metals chosen from the abovementioned metals, or of an alloy of one or more of said metals with a semimetal.

3. The composite material as claimed in claim 2, wherein the metal matrix is composed of nickel, a metal alloy of nickel with other metals or an alloy of nickel with a semimetal.

4. The composite material as claimed in claim 1, wherein the talc particles have a mean size of less than 15 μm.

5. A substrate carrying a lubricating coating, wherein the said coating is composed of the composite material as claimed in claim 1.

6. The substrate as claimed in claim 5, wherein it is composed of an intrinsically conducting material.

7. The substrate as claimed in claim 5, wherein it is composed of an insulating or semiconducting material, of which the surface to be treated has been rendered conducting by a preliminary stage of metallization.

8. A process for the deposition on a substrate of a coating composed of a composite material comprising a metal matrix within which talc particles are distributed as lamellae, which comprises carrying out an electrolytic deposition using a solution of precursors of the metal matrix of the coating, wherein the solution of precursors additionally comprises talc particles in suspension, said talc particles having been modified beforehand at the surface by irreversible adsorption of a cellulose-derived compound by replacement of all or part of the hydroxyl groups.

9. The process as claimed in claim 8, wherein it is carried out by the chemical route by bringing the surface of the substrate to be coated into contact with the solution comprising the precursors of the metal matrix, the modified particles of talc and a compound which acts as catalyst for the oxidation/reduction of the precursors of the metal matrix of the coating.

10. The process as claimed in claim 8, wherein it is carried out by the electrochemical route in an electrochemical cell in which said substrate to be coated constitutes the cathode and the electrolyte is a solution of precursors of the metal matrix of the coating additionally comprising the modified particles of talc.

11. The process as claimed in claim 10, wherein the anode of the electrochemical cell is composed of the metal forming the matrix.

12. The process as claimed in claim 8, wherein the cellulose-derived compound is chosen from carboxymethylcellulose (CMC) and guar.

13. The process as claimed in claim 8, wherein the precursors of the metal matrix are chosen from complexed or non-complexed ionic compounds which can be reduced in solution by the chemical route or by supplying electrons.

14. The process as claimed in claim 8, wherein the treatment of the talc particles with the cellulose-derived compound (CDC) comprises the following stages:

preparation of a CDC aqueous mother solution (20 to 80 g. $l^{-1}$);

preparation of a paste from demineralized water (100 ml), talc (50-150 g) and CDC (2-10 g) introduced from the CDC mother solution, homogenization being carried out with mechanical stirring (10-20 min)

complete evaporation of the aqueous phase of the paste in an oven (50-90° C.) until a dehydrated solid is obtained;

deagglomeration of the dehydrated solid in order to obtain particles of treated talc having a particle size identical to that of the initial talc powder;

first cycle: washing with demineralized water, centrifuging to separate the talc particles, evaporating the water in an oven and deagglomerating;

second washing/centrifuging/evaporating/deagglomerating cycle under the same conditions;

sieving.

* * * * *